US006740831B2

(12) United States Patent
Baertl et al.

(10) Patent No.: US 6,740,831 B2
(45) Date of Patent: May 25, 2004

(54) MECHANICAL SWITCHING CONTACT

(75) Inventors: Reinhold Baertl, Regensburg (DE); Günter Kloth, Saal (DE); Leonhard Pillmeier, Regensburg (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 0 days.

(21) Appl. No.: 10/332,355

(22) PCT Filed: Sep. 18, 2001

(86) PCT No.: PCT/EP01/10759

§ 371 (c)(1),
(2), (4) Date: Jan. 6, 2003

(87) PCT Pub. No.: WO02/31846

PCT Pub. Date: Apr. 18, 2002

(65) Prior Publication Data

US 2003/0102205 A1 Jun. 5, 2003

(30) Foreign Application Priority Data

Oct. 13, 2000 (DE) ..... 100 50 821

(51) Int. Cl.[7] ..... H01H 5/10
(52) U.S. Cl. ..... 200/459; 200/447; 200/450
(58) Field of Search ..... 200/405, 408, 200/409, 416, 436, 438, 447, 448, 450, 451, 453, 459, 467

(56) References Cited

U.S. PATENT DOCUMENTS

| | | | | | |
|---|---|---|---|---|---|
| 1,215,665 | A | * | 2/1917 | Landis | 200/409 |
| 3,315,043 | A | | 4/1967 | Baumgartner | |
| 4,316,063 | A | * | 2/1982 | Starck | 200/450 |
| 4,902,864 | A | * | 2/1990 | Markowski et al. | 200/459 |
| 5,426,274 | A | * | 6/1995 | Bruggemann et al. | 200/447 |

FOREIGN PATENT DOCUMENTS

| | | |
|---|---|---|
| CH | 237860 | 9/1945 |
| DE | 21 30 509 | 12/1972 |
| DE | 41 01 866 | 7/1992 |
| WO | WO 95/24724 | 9/1995 |
| WO | WO 96/30922 | 10/1996 |

* cited by examiner

*Primary Examiner*—Renee Luebke
(74) *Attorney, Agent, or Firm*—Herbert Dubno

(57) ABSTRACT

The invention relates to a mechanical switching contact for bipolar commutation comprising an insulating support having fixed contacts disposed therein. Said contacts are switchable by means of a contact carrier which possesses a pivoting arm on the free end and thereof with a respective conducting contact element. The whole mechanical switching contact is configured as a modular unit which can be assembled in an optional manner.

4 Claims, 4 Drawing Sheets

MECHANICAL SWITCHING CONTACT

CROSS REFERENCE TO RELATED APPLICATIONS

Figure 1:
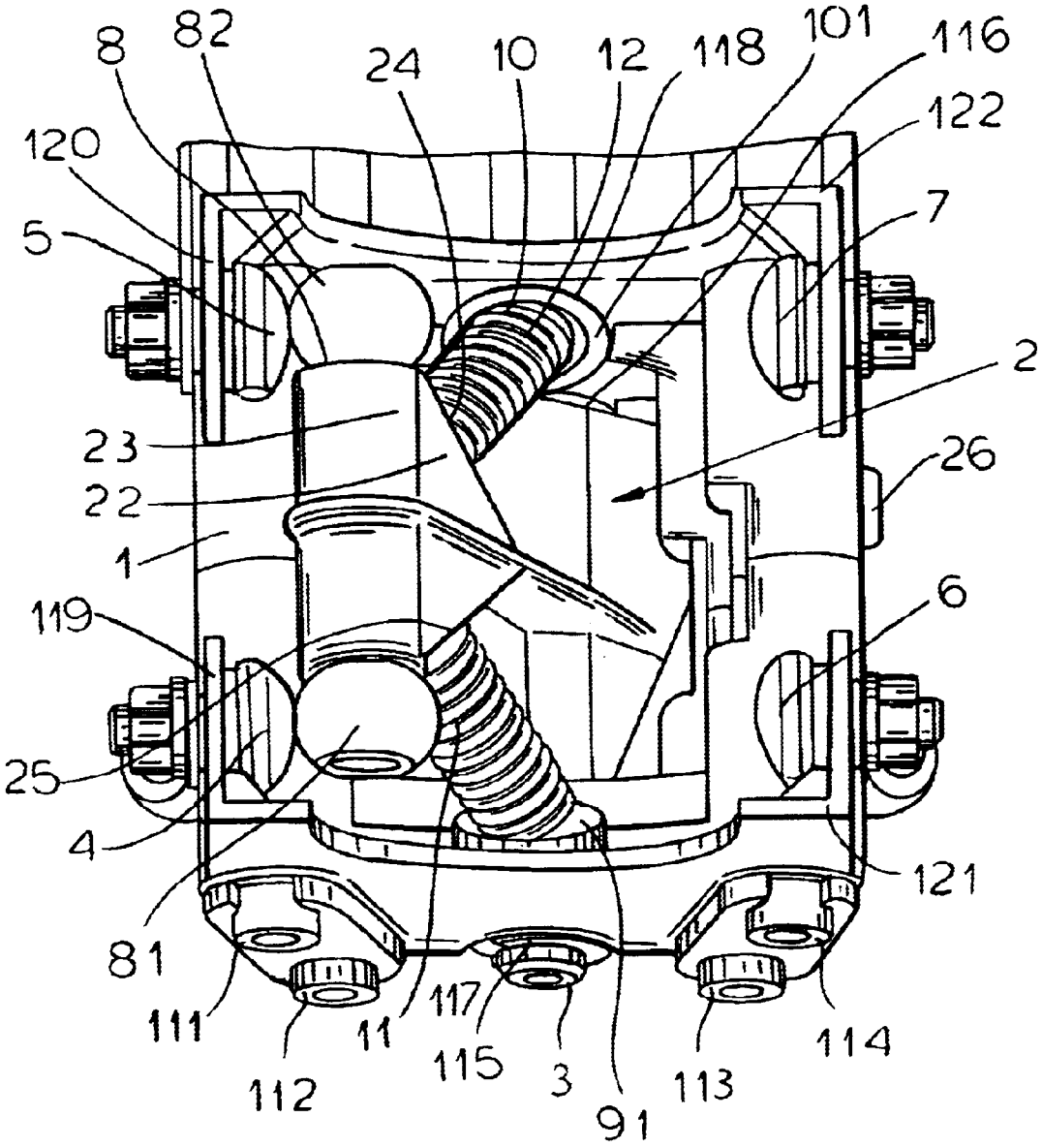

This application is a national stage of PCT/EP01/10759 filed 18 Sep. 2001 and is based upon German national application 100 50 821.9 of 13 Oct. 2000 under the International Convention.

FIELD OF THE INVENTION

The invention relates to a mechanical switching contact for double pole or bipolar switchover, especially under-load switchover, of a tap changer or step switch, especially for a tapped transformer.

BACKGROUND OF THE INVENTION

A switchover arrangement for the switchover under load of a tap changer is known from WO 95/24724 (U.S. Pat. No. 5,786,552), which has a mechanical main switching contact and an also mechanical resistance switching contact. Both the main switch contact and also the resistance switching contact are comprised of two mutually interconnected actuatable individual interrupter contacts whereby each individual interrupter contact of the main switching contact and also of the resistance switching contact is electrically connected with the first load switching side and the respective other individual interrupter contact of both the main switching contact and also of the resistance switching contact are electrically connected with the second load switchover side. With this arrangement, the individual interrupter contacts of the main switching contact are switchable through a first changeover switch and the individual interrupter contacts of the resistance switching contact are switchable through a second changeover switch. There is thus a respective double-pole switchover by means of two changeover contacts.

From WO 96/309222 (U.S. Pat. No. 5,834,717) an underload switchover for a tap changer [step switch] is known which technologically is proposed in the form of a double-pole switch having mechanical contacts pivotable in a lever-like manner about a pivot point. In addition, spring-loaded toggle levers are provided which act upon the rotatably mounted mechanical contacts in such manner that these can assume two switching positions on either side of a dead point. The two movable contacts are arranged in the same horizontal plane at the outer region of the load switch for each phase.

This known configuration of the mechanical switching contacts for double-pole interruption is however complex and technologically expensive, requires precise adjustment after mounting and needs for that purpose a relatively large amount of space.

OBJECT OF THE INVENTION

It is the object of the invention therefore to provide a mechanical switch contact for a double pole or bipolar switchover which is of simple construction and has the smallest possible number of parts to facilitate mounting and therefore has a modular configuration so that it is composed of a self-standing component which can be built into a device for switching over under load without further adjustment or matching efforts and in addition will occupy the smallest possible space.

SUMMARY OF THE INVENTION

This object is achieved with a mechanical switching contact for double-pole switchover, especially for an underload switchover, of a tap changer, with the following features:

- it has an insulating carrier or support on which fixed contacts are arranged pairwise and opposite one another;
- on the insulating carrier a contact carrier is rotatably mounted which has on one of its two free ends a pivot arm and which has an actuating contour on its other free end;
- on the pivot arm an electrically conducting contact piece is so arranged that depending upon the respective possible end position of the contact carrier in a stationary state conductively connects two of the fixed contacts which are arranged pairwise adjacent one another on one of the two sides; and
- on both sides of the pivot arm telescoping guides each with a respective compression spring are provided which respectively have one of their free ends braced against the contact carrier and with the other free end braced against the insulating carrier such that the contact carrier has a snap effect and by application of force to the actuating contour is swingable to jump from one stationary state into another stationary state.

The telescoping guides with respective compression springs-are braced each at one on their free ends on an abutment receiver on the contact carrier and with the respective other free end on a cup receiver on the insulating carrier such that a three-dimensional spatial mounting at the bracing points is produced.

The insulating longitudinal guides are such that at least two identical mechanical switch contacts are modularly connectable with one another.

The contact piece in the middle region in a contact receiver of the pivot arm has on its two free ends each a respective contact roller each of which cooperates with a respective one of the fixed contacts.

The important advantage of the mechanical switching contact of the invention resides in its extraordinarily compact and simple construction. With fewer parts it allows both the mechanical main switching contact as well as the mechanical resistance switching contact to be prefabricated as identical modular components. For the main switching contact as well as for the resistance switching contact the same modular mechanical switching contacts are useable.

The main switch contact and resistance switching contact of each phase can be realized in a simple manner as common components of two identical, mutually connected modular switch contacts according to the invention.

BRIEF DESCRIPTION OF THE DIAGRAM

The invention is described below in greater detail with reference to the accompanying drawing.

Figure 2:
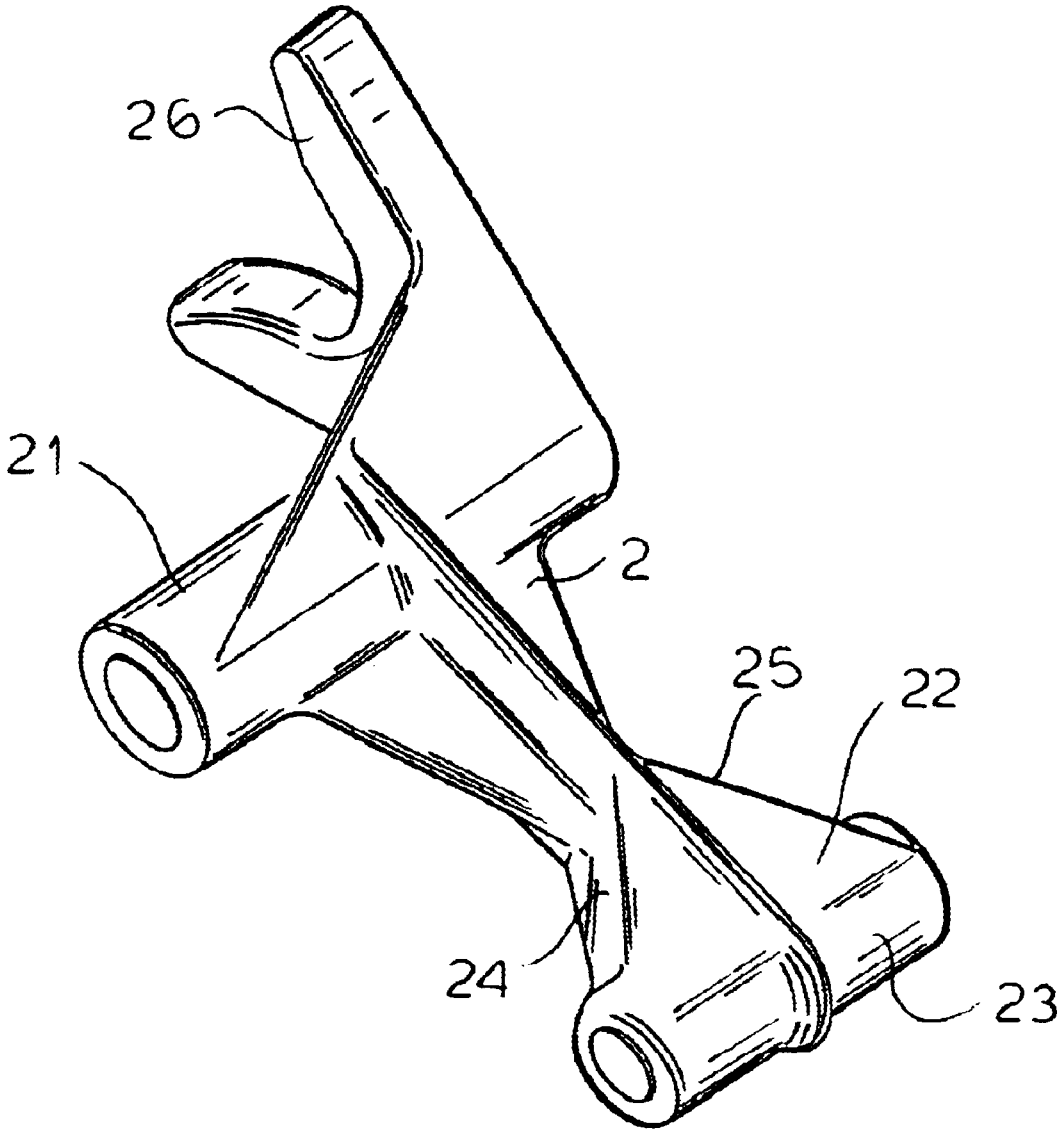
Figure 3:
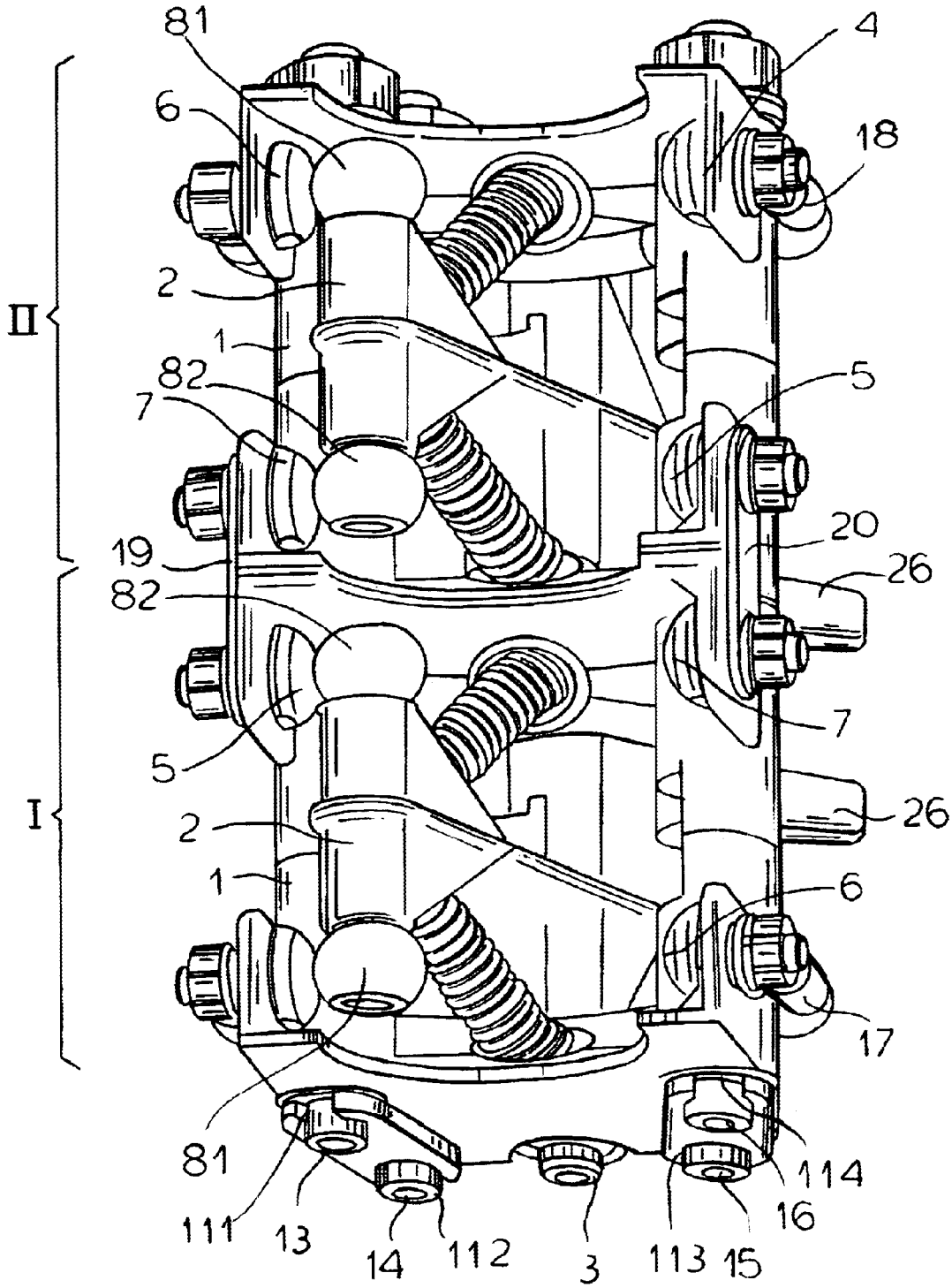
Figure 4:
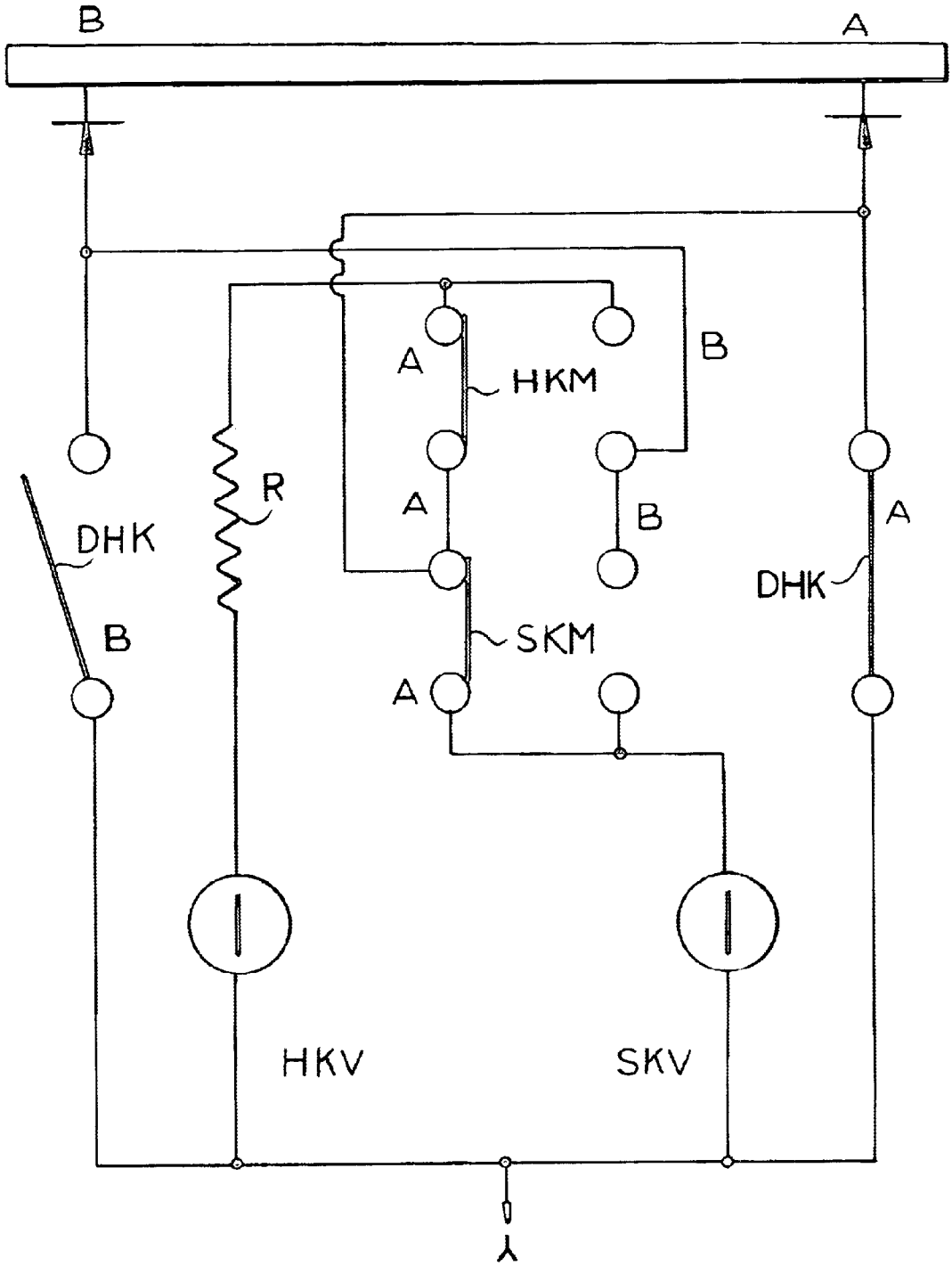

In the drawing:

FIG. 1 is a perspective view of a mechanical switch contact in accordance with the invention;

FIG. 2 is a perspective view of a contact carrier of the switch contact illustrated in FIG. 1 shown by itself FIG. 3 is a perspective view of a combination of two switch contacts of the invention according to FIG. 1 as a unitary single phase component for the main switch contact and the resistance switch contact; and FIG. 4 is a diagram of a circuit of the load switch of a tap changer as can be achieved with the mechanical switch contacts according to the invention.

SPECIFIC DESCRIPTION

Initially the mechanical switch contact shown in FIG. 1 according to the invention will be described in greater detail.

It has a carrier or support 1 of insulating material on which the further components described subsequently are carried. The insulating carrier 1 is provided with longitudinal guides 111, 112, 113 and 114 which run parallel to one another in the form of throughgoing bores which will be referred to further again below. In addition it has two bearing locations 115 and 116 in which a 10 contact carrier 2 is rotatably journaled by means of a bearing pin 3. In the regions of the two bearing locations 115 and 116, lateral cup-shaped receivers 117 and 118 are provided which also will be discussed in greater detail subsequently. In addition, the insulated carrier has contact receivers 119, 120, 121, 122 in which the fixed contacts 4, 5, 6, 7 are disposed.

The contact carrier 2 which is illustrated by itself in FIG. 2 is rotatably mounted in the insulated carrier 1 by means of a bearing 21 and the previously mentioned bearing pin 3. Each has a pivot arm 22 which is swingable about the bearing 21 and in turn has a contact receiver 23 on its free end. This contact receiver 23 is comprised of a throughgoing bore which runs parallel to the longitudinal axis of the bearing 21 or the bearing pin 3. Laterally in the region of the contact receiver 23 are respective abutment receivers 24 or 25 which are also cup-shaped. At its other opposite free end, the contact carrier 2 has a actuating contour 26. In the contact receiver 23, an electrically-conductive contact piece 8 is disposed which has on its both free ends contact rollers 81 and 82. These contact rollers 81 and 82 correspond respectively either with the fixed contacts 4 and 5 on one side of the insulated carrier 2 or the fixed contacts 6 and 7 on the other side of the insulated carrier 1 depending upon in which direction the contact carrier 2 is pivoted about the bearing 21.

Between the contact carrier 2 and the insulated carrier 1 there are also two telescoping guides 9 and 10 on both sides. These telescoping guides 9 and 10 are comprised of two tube segments slidable one within another. They have respectively at one free end a pocket 91 or 101 with which they are respectively braced in one of the cup-shaped receivers 117 or 118of the insulated carrier. At their respective other free ends, the telescoping guides 9 and 10 have each a spherical abutment with which they are braced in respective ones of the two abutment receivers 24, 25 on both sides of the contact carrier 2. In addition, surrounding the first telescoping guide 9 there is a prestressed compression spring 11 which is also braced between the cup-shaped receiver 117 and the abutment receiver 24 on the contact carrier 2. Around the second telescope guide 10 in a completely analogous manner a further prestressed compression spring 12 is arranged which in its turn is braced between the cup-shaped recess 118 and the other abutment 25 on the contact carrier 2.

In the position shown in FIG. 1, therefore, the two fixed contacts 4 and 5 are electrically connected via the contact rollers 81 and 82, which are electrically connected together by the contact piece 8. The actuation of the load switch uses a roller or the like which is introduced into the actuating contour 26 and runs on the latter so that the entire contact carrier swings downwardly against the force of the prestressed compression springs 11 and 12 about its bearing 21. As a consequence the two contact rollers 81 and 82 then connect the oppositely lying fixed contacts 6 and 7. Through the telescoping guides 9 and 10 in combination with the described springs 11 and 12, a snap mechanism is obtained in a simple manner which on the one hand prevents the contact carrier 2 from assuming a nondefined intermediate position and on the other hand provides a sufficient contact pressure of the contact rollers 81 and 82 on the respective fixed contact. The lateral cups 91 or 92 of this telescoping guide 9 and 10, which are respectively engaged in the cup-shaped recesses 117 or 118 of the insulated carrier, function as spatial three-dimensional braces. The telescoping guides 9 and 10 vary in length in switchover, i.e. the swinging of the contact carrier 2, and therefore are formed to be telescopic, as well as in their spatial orientation.

In FIG. 3, two of these switch contacts according to the invention have been shown and are assembled to a complete mechanism switch unit for one phase of a load switch. In this case, one switch contact I functions as a main-switch contact and the other switch contact II has the resistance switch contact. Identical parts have been provided with identical reference characters—it can be noted that both modules are constructed completely identically. For reasons of clarity, in this drawing not all of the explained details have been provided with reference characters. In FIG. 3 as has been shown in FIG. 1 for a single switch contact, an asymmetrical design of the actuating contour 26 of the contact arm 2 has been selected. Here the two switching contacts I and II are rotated through 180° with respect to one another so that the two actuating contours are turned toward one another. This is however only one of many possible embodiment configurations. The connection of the two switch contacts I and II is effected by common connecting bolts 13, 14, 15, 16 which pass through the respective longitudinal guides 111, 112, 113, 114 and are threaded on both sides. It can be seen further from FIG. 3 that the respective oppositely lying fixed contacts 4 and 6 of each switch contact I and II are connected together by a respective connecting cable 17, 18. It should be noted further that the neighboring contacts 5 and 7 of each switch contact are on one side connected together by a first conductive connection 19 and the correspondingly neighboring fixed contact 7 and 5 on the other side are electrically connected together by a further conductive connection 20. Thus a double-pole switchover for an under-load switch of a tap changer or step switch can be realized.

This is illustrated again in FIG. 4: in the upper part of the circuit the selector of the step switch or tap changer has been schematically illustrated and permits a power-less selection of the new winding tap n+1 of the tap changer to which the switchover shall occur while the previous winding tap n is still electrically connected in circuit. Below it are the two sides of the switch A and B for switching over under load and between which, in the sequence, there should be an interruption-free switchover under load. Further therebelow the mechanical switch contacts are shown and, indeed, in the left branch, the main switching branch, the main switching contacts SK. The indices A or B indicate the respective arrangements corresponding individual contact on side A or side B of the load switch. In the right branch, the resistance branch, the resistance switch contacts HKM which are completely analogous, have been shown; for all of the indices the same applies. The broken line indicates the part of the circuit which is technically realized by both of the mechanical switch contacts I and II of the invention. Underneath it further in the main switch path, there is the first vacuum switching cell SKV which is connected in series and serves as a load discharger, in the resistance branch are the series circuit of a bridging resistance and a second vacuum switching cell HKV for load discharge L.

What is claimed is:

1. A mechanical switch comprising:

an insulating support;

a first pair of mutually spaced contacts fixed on one side of said support and a second pair of mutually spaced contacts fixed on another side of said support opposite the contacts of said first pair;

a contact carrier rotatably mounted on said support and having two free ends, an electrically conducting contact piece on one of said ends engageable with the contacts of said first pair to electrically connect the contacts of said first pair in one pivotal position of said carrier and engageable with the contacts of said second pair to electrically connect the contacts of said second pair in another pivotal position of said carrier, and an actuating contour on the other of said ends enabling displacement of said contact carrier between said positions; and a pair of telescoping guides on opposite sides of said contact carrier, each of said telescoping guides having a respective compression spring and being braced at one end against a respective side of the contact carrier and at an opposite end against said support such that the contact carrier has a snap effect and by application of force to said actuating contour is swingable to jump from one of said positions into the other position corresponding to respective stationary states of said carrier.

2. The mechanical switch defined in claim 1 wherein said contact carrier has respective abutment receivers and said support has respective cup receivers against which said ends of said telescoping guides are braced such that a three-dimensional spatial mounting is provided at respective bracing locations.

3. The mechanical switch defined in claim 1 wherein said support is provided with longitudinal guides enabling alignment of two identical supports with respective contact carriers, telescoping guides and contacts in a modular assembly, of two of said switches.

4. The mechanical switch defined in claim 1 wherein said electrically conducting contact piece has respective contact rollers engageable with the contacts of said first and second pairs.

* * * * *